US011319751B2

(12) United States Patent
Zhu et al.

(10) Patent No.: US 11,319,751 B2
(45) Date of Patent: May 3, 2022

(54) TELESCOPIC POSITIONING STRUCTURE USED FOR LADDER

(71) Applicant: Jiangsu Zhou Jijie Intelligent Technology Co., Ltd, Suqian (CN)

(72) Inventors: Chen Hui Zhu, Suqian (CN); Baisong Yao, Suqian (CN)

(73) Assignee: JIANGSU ZHOU JIJIE INTELLIGENT TECHNOLOGY CO., LTD, Suqian (CN)

( * ) Notice: Subject to any disclaimer, the term of this patent is extended or adjusted under 35 U.S.C. 154(b) by 541 days.

(21) Appl. No.: 16/293,651

(22) Filed: Mar. 6, 2019

(65) Prior Publication Data

US 2020/0240209 A1 Jul. 30, 2020

(30) Foreign Application Priority Data

Jan. 25, 2019 (CN) ..... 201920131329.X

(51) Int. Cl.

| | |
|---|---|
| ***E06C 7/18*** | (2006.01) |
| ***E06C 7/14*** | (2006.01) |
| ***E06C 7/50*** | (2006.01) |
| ***E06C 1/22*** | (2006.01) |
| ***E06C 7/08*** | (2006.01) |
| *E06C 1/393* | (2006.01) |

(52) U.S. Cl.

CPC ..... *E06C 7/182* (2013.01); *E06C 1/22* (2013.01); *E06C 7/08* (2013.01); *E06C 7/14* (2013.01); *E06C 7/50* (2013.01); *E06C 1/393* (2013.01)

(58) Field of Classification Search

CPC ..... E06C 7/04; E06C 7/08; E06C 7/14; E06C 7/50; E06C 7/182

See application file for complete search history.

(56) References Cited

U.S. PATENT DOCUMENTS 2,467,800 A * 4/1949 Backlin ..... E06C 7/182 182/106
4,485,892 A * 12/1984 Maloney ..... E06C 1/393 182/161
6,026,933 A * 2/2000 King ..... E06C 1/387 182/161

(Continued)

FOREIGN PATENT DOCUMENTS

CN 206376733 U * 8/2017 ..... E06C 1/393
CN 212359594 U * 1/2021

(Continued)

*Primary Examiner* — Daniel P Cahn
*Assistant Examiner* — Candace L Bradford
(74) *Attorney, Agent, or Firm* — Bayramoglu Law Offices LLC

(57) ABSTRACT

A telescopic positioning structure used for a ladder is disclosed. The ladder includes a front supporting leg and a rear supporting leg. The front supporting leg includes a first tube and a second tube, and the first tube and the second tube are able to move relative to each other in an extension direction. The rear supporting leg is rotatably connected with the first tube. The ladder further includes a pin connected with the first tube. When the rear supporting leg is unfolded, an upper end of the rear supporting leg abuts against the pin and drives to the pin to move towards the second tube, and when the pin abuts against the second tube, the second tube is positioned.

14 Claims, 4 Drawing Sheets

(56) References Cited

U.S. PATENT DOCUMENTS

| | | | | |
|---|---|---|---|---|
| 6,443,261 | B1 * | 9/2002 | Gibson | E06C 1/16 182/104 |
| 10,837,229 | B2 * | 11/2020 | Yoo | E06C 1/393 |
| 2003/0057022 | A1 * | 3/2003 | Leng | E06C 7/50 182/165 |
| 2004/0000449 | A1 * | 1/2004 | Meeker | E06C 1/387 182/106 |
| 2008/0142301 | A1 * | 6/2008 | Meyers | E06C 1/387 182/180.1 |
| 2018/0148977 | A1 * | 5/2018 | Leng | E06C 1/387 |
| 2019/0330920 | A1 * | 10/2019 | Boyer | E06C 1/383 |
| 2020/0095828 | A1 * | 3/2020 | Demi | E06C 7/423 |
| 2020/0240207 | A1 * | 7/2020 | Zhu | E06C 7/04 |
| 2021/0262287 | A1 * | 8/2021 | Yoo | E06C 7/08 |
| 2021/0262288 | A1 * | 8/2021 | Maxfield | E06C 7/50 |

FOREIGN PATENT DOCUMENTS

| | | | | | |
|---|---|---|---|---|---|
| EP | 1980707 | A1 * | 10/2008 | E06C 1/20 |
| EP | 3415707 | A1 * | 12/2018 | E06C 7/183 |
| GB | 979347 | A * | 1/1965 | A47C 12/02 |
| WO | WO-2008041156 | A2 * | 4/2008 | E06C 7/06 |
| WO | WO-2019243521 | A * | 12/2019 | E06C 1/382 |

* cited by examiner

TELESCOPIC POSITIONING STRUCTURE USED FOR LADDER

CROSS REFERENCE TO RELATED APPLICATIONS

This application is based upon and claims priority to Chinese Patent Application No. 201920131329.X, filed on Jan. 25, 2019, the entire contents of which are incorporated herein by reference.

TECHNICAL FIELD

The invention relates to a telescopic positioning structure used for a ladder, and belongs to the technical field of household articles.

BACKGROUND

In the prior art, a ladder provided with a telescopic backrest includes a pair of ladder legs and a plurality of steps mounted on the ladder legs, wherein a connecting piece is arranged on the upper portions of the ladder legs, a mounting part extends outwards from the connecting piece, a tool stand is pivoted to the mounting part through a pivot, the lower portion of the backrest is located between the connecting piece and the pivot, an elastic cushion block is arranged between the backrest and the pivot, and the tool stand is provided with a cam part pressing against the cushion block. The tool stand can be turned to reduce the logistics size, but the length still cannot be changed.

SUMMARY

The objective of the invention is to overcome the above defects of the prior art by providing a telescopic positioning structure which is used for a ladder and is reasonable in structural design and capable of achieving stable and reliable positioning.

The technical solution adopted by the invention to fulfill the above objective is to provide a telescopic positioning structure used for a ladder. The ladder includes a front supporting leg and a rear supporting leg. The front supporting leg includes a first tube and a second tube, wherein a size of the first tube is larger than a size of the second tube; the first tube and the rear tube are able to move relative to each other in an extension direction, and the rear supporting leg is rotatably connected to the first tube. The ladder further includes a pin connected to the first tube. When the rear supporting leg is unfolded, an upper end of the rear supporting leg abuts against the pin and drives the pin to move towards the second tube, and when the pin abuts against the second tube, the second tube is positioned.

Further, the pin is connected to an elastic piece, and the elastic piece applies a force to the pin to enable the pin to release the positioned second tube.

Further, an end cover is arranged at the upper end of the rear supporting leg and is provided with a slope; when the rear supporting leg is unfolded, the slope abuts against the pin; and in the process of unfolding the rear supporting leg, the pin is pushed to move to position the second tube.

Further, the ladder further includes a connecting piece fixedly connected to the front supporting leg, the connecting piece is provided with a mounting cavity allowing the first tube to be inserted therein, the mounting cavity is vertically through, and the first tube is arranged in the mounting cavity and is fixedly connected to the connecting piece; and a connecting part rotatably connected to the rear supporting leg extends out of the connecting piece, and the rear supporting leg is rotatably connected to the connecting part.

Further, the second tube arranged in the mounting cavity is provided with a flange which protrudes out of an outer-diameter portion of the second tube, and a cover is arranged on the mounting cavity; and when the second tube moves upwards, the flange abuts against the cover, the pin is located on a lower end face of the second tube, and the first tube and the second tube are locked.

Further, the second tube is provided with hole allowing the pin to be inserted therein, and when the pin is inserted into the hole, the first tube and the second tube are locked.

Further, the connecting part is provided with a second mounting cavity allowing the second tube to stretch therein, two arms are arranged in the second mounting cavity, and the elastic piece is located between the two arms.

Further, the pin and the connecting piece are rotatably arranged; or, the pin and the connecting piece are movably arranged in the radial direction of the first tube.

Further, the pin includes a pin head and a pin handle, the pin head is fixedly connected to the pin handle, the pin handle is provided with a rod to be sleeved with the elastic piece, and the elastic piece is arranged around the rod with an end abutting against the pin handle and an end abutting against the connecting piece or the first tube.

Further, the second tube of the front supporting leg is connected to a tool stand.

Compared with the prior art, the invention has the following advantages and effects:

The rear supporting leg always abuts against the pin in use, so that the pin is fixed, and thus, the second tube is positioned stably and reliably.

The tool stand is of a telescopic lifting structure so that the size can be reduced for logistics packaging; and the tool stand moves upwards when the second tube moves upwards so that the stability can be improved through the second tube or the tool stand when users climb the ladder to work.

DETAILED DESCRIPTION OF THE EMBODIMENTS

The invention is further expounded below with reference to the accompanying drawings and embodiments. The following embodiments are used to explain the invention, but are not intended to limit the invention.

Embodiment 1

Figure 1:
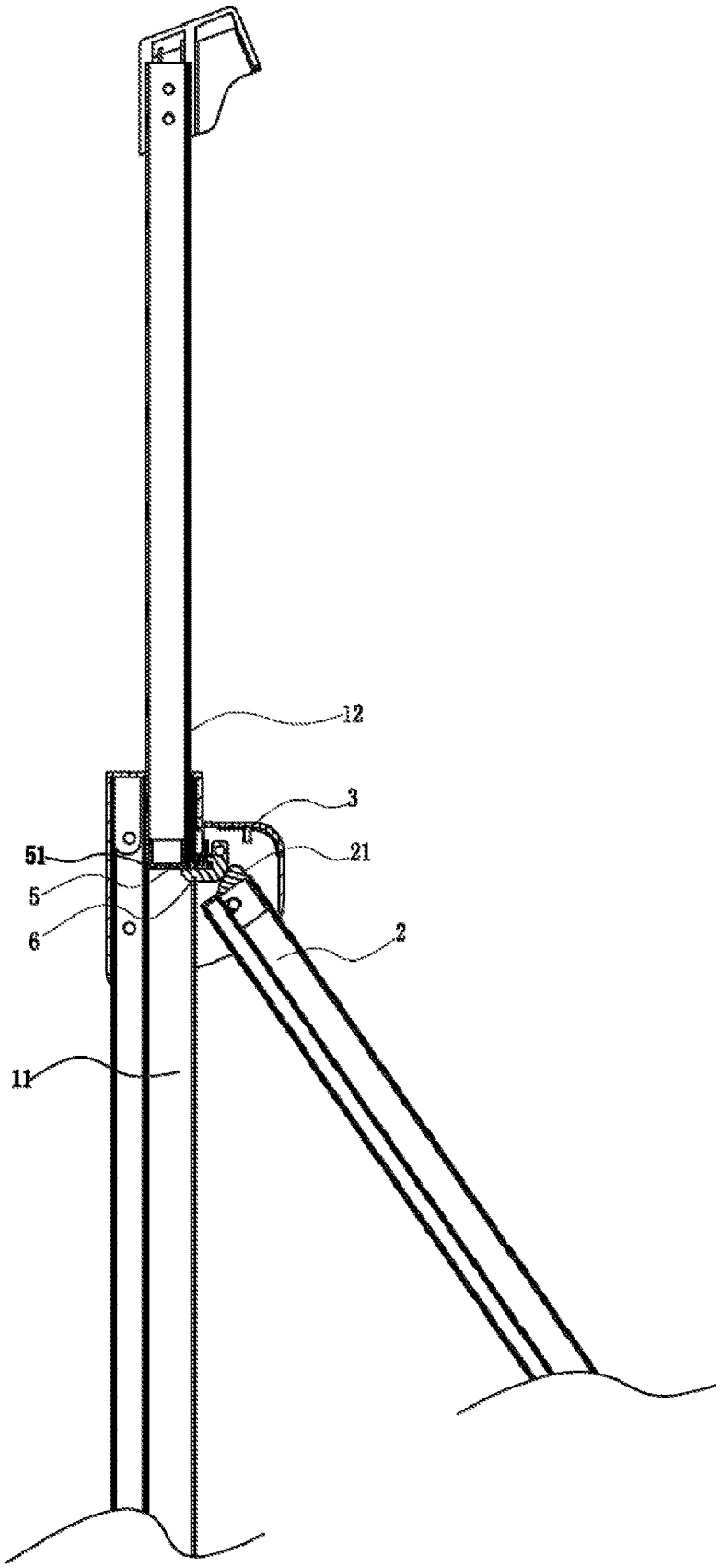
FIG. 1 is a structural view of the invention.
Figure 2:
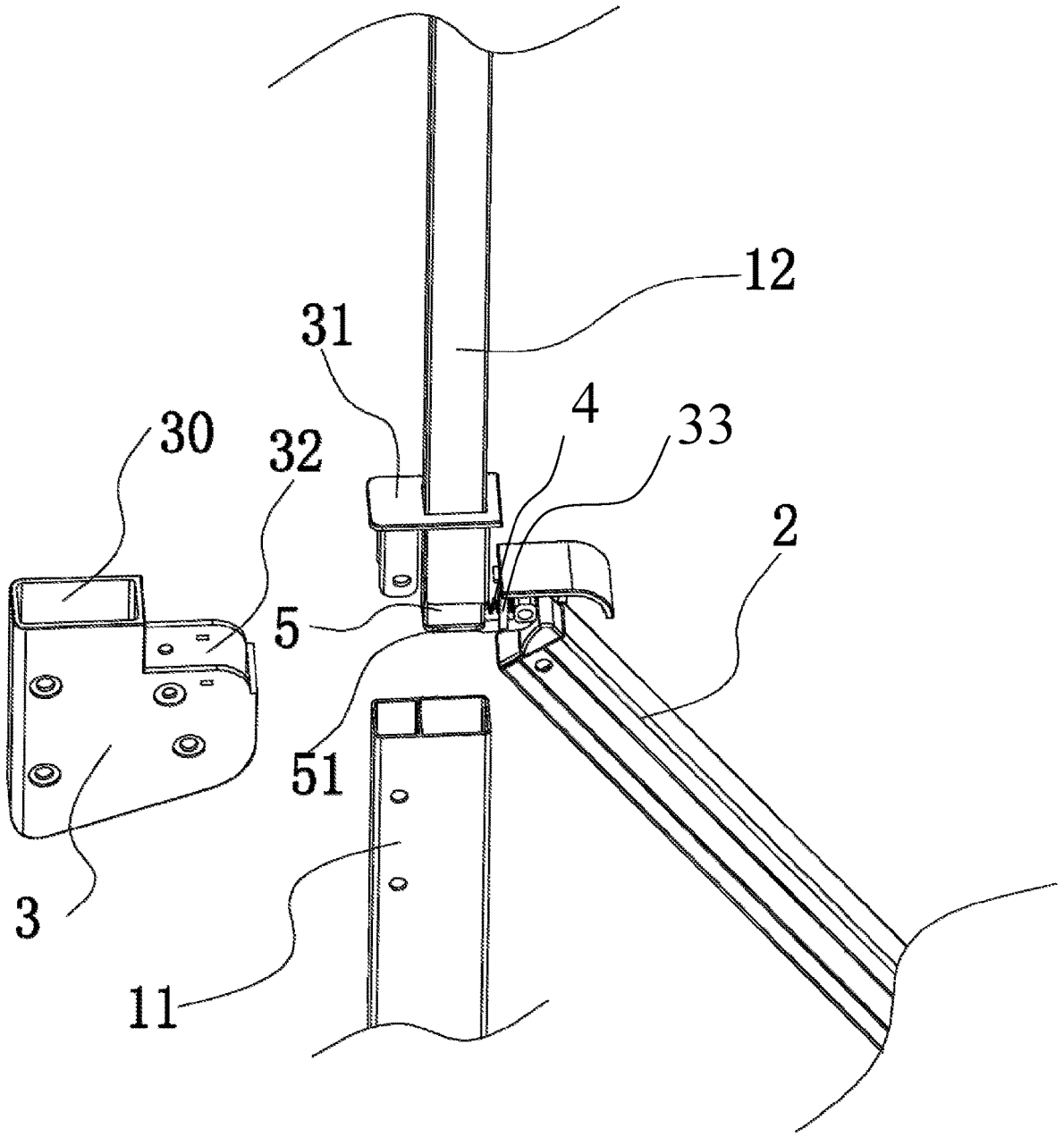
FIG. 2 is an exploded view of the invention.
Figure 3:
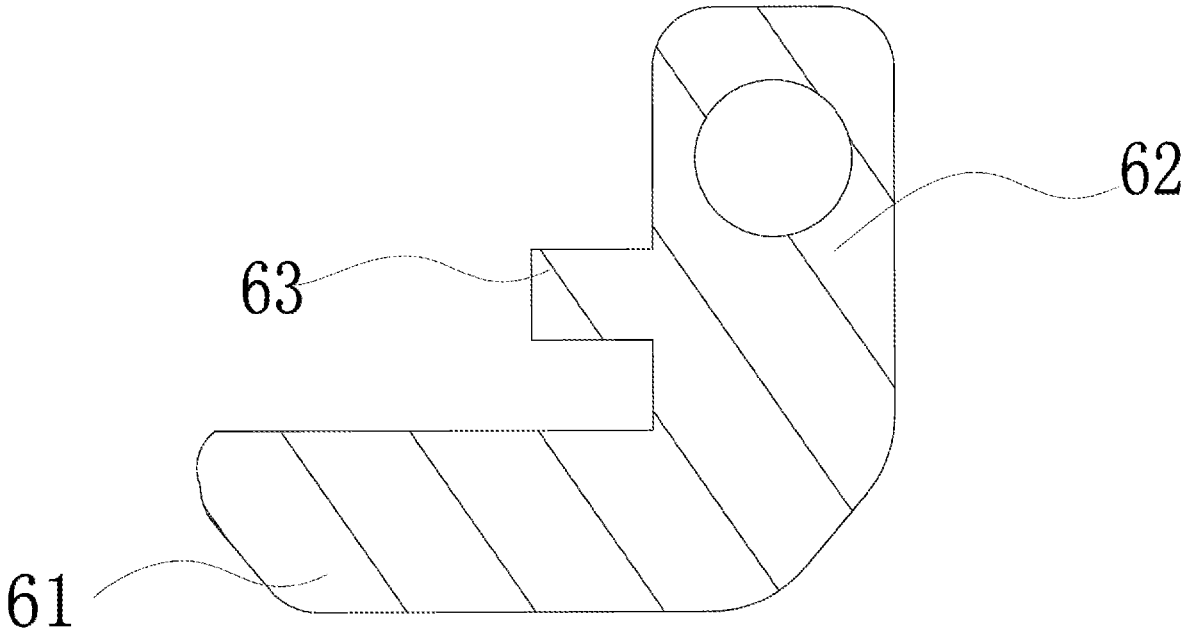
FIG. 3 is a structural view of a pin of the invention.
Figure 4:
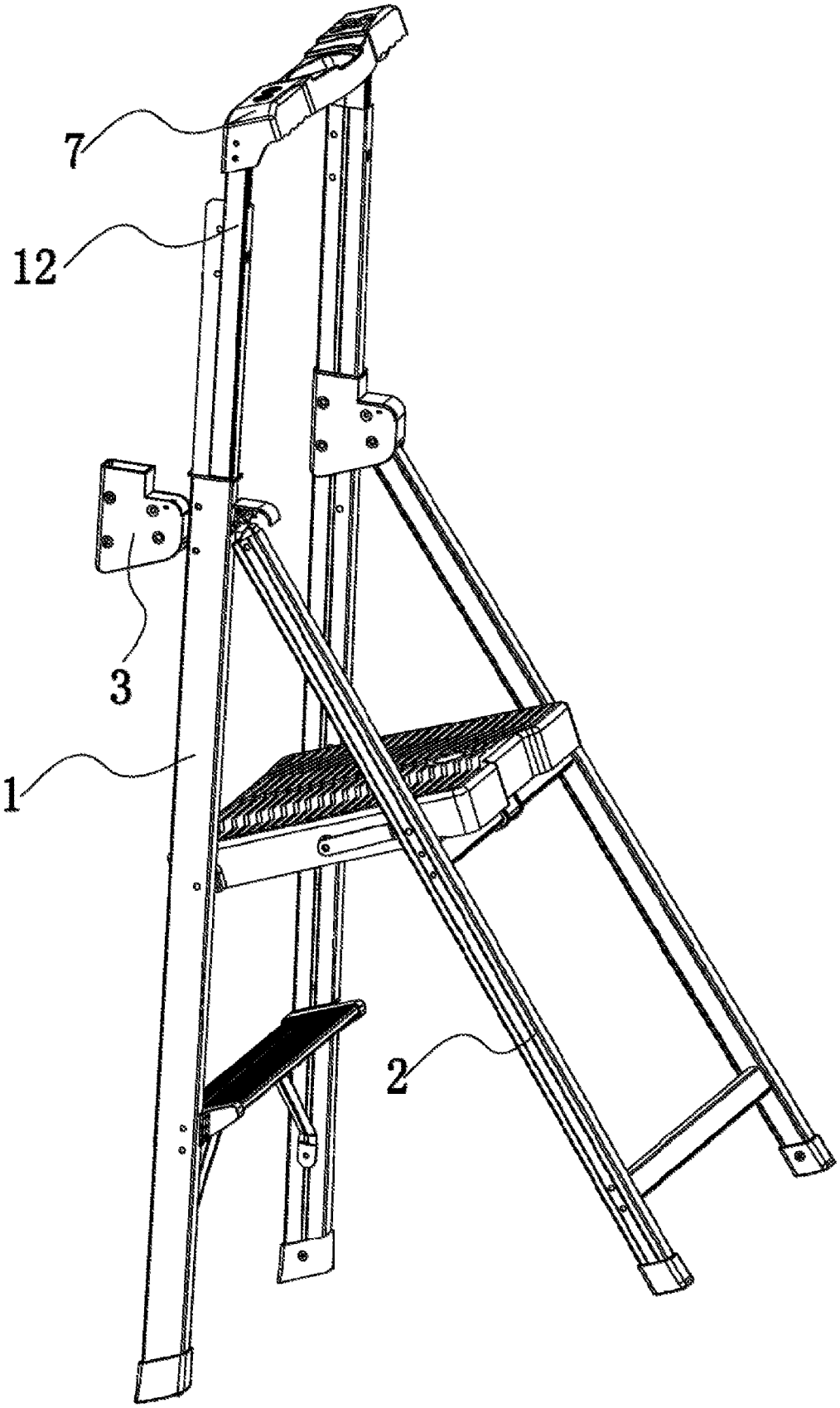
FIG. 4 is a structural view of the invention in use.

Referring to FIGS. 1-4, the invention provides a telescopic positioning structure used for a ladder. The ladder includes a front supporting leg 1 and a rear supporting leg 2. The front supporting leg 1 includes a first tube 11 and a second tube 12, wherein a size of the first tube 11 is larger than a size of the second tube 12, the first tube 11 and the second tube 12 are able to move relative to each other in an extension direction, and the rear supporting leg 2 is rotatably connected to the first tube 11. In this embodiment, the ladder further includes a pin 6 connected to the first tube 11. When the rear supporting leg 2 is unfolded, an upper end of the rear supporting leg 2 abuts against the pin 6 and drives the pin 6 to move towards the second tube 12, and when the pin 6 abuts against the second tube 12, the second tube 12 is positioned. In this embodiment, the pin 6 is directly or indirectly connected to the first tube 11, or the pin 6 is rotatably connected to the first tube 11, or the pin 6 is limited in the extension direction of the first tube 11 and is movable in the radial direction; the pin 6 can also be rotatably connected to a connecting piece 3, or the pin 6 moves in the connecting piece 3 in the radial extension direction of the first tube 11 under limitation, for instance, the pin 6 moves leftwards or rightwards in the horizontal direction. In this embodiment, the pin 6 abuts against an outer wall or an end of the second tube 12 or abuts against a hole in the second tube 12. When the pin 6 is rotatably connected to the first tube 11 or the connecting piece 3, the rotation point of the pin 6 is fixed, and the pin 6 abuts against the second tube 12 and is then pushed by the rear supporting leg 2, so that the second tube 12 is positioned. In this structure, with the increase of a force borne by the rear supporting leg 2, the pin 6 presses against the second tube 12 more firmly. In the invention, the first tube 11 and the second tube 12 are not limited to traditional round tubes or square steel and can also be other hollow sections.

In this embodiment, the pin 6 is connected to an elastic piece 4, the elastic piece 4 applies a force to the pin 6 to unlock the first tube 11 and the second tube 12, and the pin 6 has a tendency to be away from the second tube 12 under the elastic force of the elastic piece 4. Preferably, the elastic piece 4 is a spring having an end abutting against the pin 6 and an end abutting against the first tube 11 or an extension part connected to the first tube 11.

In this embodiment, an end cover 21 is arranged at the upper end of the rear supporting leg 2, is made from plastic and is provided with a slope. When the rear supporting leg 2 is unfolded, the slope abuts against the pin 6; and in the process of unfolding the rear supporting leg 2, the pin 6 is pushed to move to lock the first tube 11 and the second tube 12. The pin 6 has to move by a certain distance to lock the first tube 11 and the second tube 12, and when used for locking the first tube 11 and the second tube 12, the pin 6 moves away from the original position, and then the slope gradually pushes the pin 6 to move in a locking direction. In this embodiment, the slope is a linear slope or a curved slope.

The ladder in this embodiment further includes the connecting piece 3 fixedly connected to the front supporting leg 1, wherein the connecting piece 3 is provided with a mounting cavity 30 allowing the first tube 11 to be inserted therein, the mounting cavity 30 is vertically through, and the first tube 11 is arranged in the mounting cavity 30 and is fixedly connected to the connecting piece 3. A connecting part rotatably connected to the rear supporting leg 2 extends out from the connecting piece 3, and the rear supporting leg 2 is rotatably connected to the connecting part. Preferably, in this embodiment, the connecting part is provided with second mounting cavity 32 allowing the second tube 12 to stretch therein, two arms 33 are arranged in the second mounting cavity 32, and the elastic piece 4 is located between the two arms 33. The elastic piece 4 is limited by the arms 33.

In this embodiment, the second tube 12 arranged in the mounting cavity 30 is provided with a flange 51 protruding out of an outer-diameter portion of the second tube 12, wherein the flange 51 is directly formed on the second tube 12; or, an end plug 5 is fixedly arranged under the second tube 12, and an outer edge of the end plug 5 extends out of the outer-diameter portion of the second tube 12 to form the flange 51. A cover 31 is fixedly arranged on the mounting cavity 30. When the second tube 12 moves upwards, the flange 51 abuts against the cover 31, the pin 6 abuts against the second tube 12 or a lower end face of the flange 51, and the first tube 11 and the second tube 12 are locked. In this structure, the second tube 12 is supported by the pin 6 and is blocked and limited by the cover 31, thereby being positioned both in the upward direction and in the downward direction.

In this embodiment, the second tube 12 is provided with a hole allowing the pin 6 to be inserted therein, and when the pin 6 is inserted into the hole, the first tube 11 and the second tube 12 are locked. In this structure, the second tube 12 is provided with the hole, the pin 6 is inserted into the hole to abut against the second tube 12, and thus, the second tube 12 is positioned more stably.

In this embodiment, the pin 6 and the connecting piece 3 are rotatably arranged. The pin 6 is rotatably connected to the connecting piece 3 through a hinge pin, and the rotation point is fixed and is also a stress point. The pin 6 is rotatably connected to the connecting piece 3 to bear forces, so that assembling is simple and reliable.

In this embodiment, the pin 6 includes a pin head 61 and a pin handle 62, wherein the pin head 61 is fixedly connected to the pin handle 62, the pin handle 62 is provided with a rod 63 to be sleeved with the elastic piece 4, and the elastic piece 4 is arranged around the rod 63 with an end abutting against the pin handle 62 and an end abutting against the connecting piece 3 or the first tube 11. Preferably, the pin head 61 is perpendicular to the pin handle 62, and on this basis, the structure is reasonable and reliable by adoption of a rotary connection way.

In use, two front supporting legs 1 are adopted, and the second tubes 12 of the two front supporting legs 1 are connected to a tool stand 7, and the second tubes 12 move relative to the first tubes 11 to lift or lower the tool stand 7.

The above embodiments described in the specification are only illustrative ones of the invention. Various modifications, supplements or similar substitutes of these specific embodiments made by those skilled in this field without deviating from the contents in the specification of the invention or going beyond the scope defined by the claims should also fall within the protection scope of the invention.

What is claimed is:

1. A telescopic positioning structure of a ladder, wherein the ladder comprises a front supporting leg and a rear supporting leg; the front supporting leg comprises a first tube and a second tube; a size of the first tube is larger than a size of the second tube; the first tube and the second tube are allowed to move relative to each other in an extension direction; the rear supporting leg is rotatably connected to the first tube; the ladder further comprises a pin connected to the first tube; when the rear supporting leg is unfolded, an upper end of the rear supporting leg abuts against the pin and drives the pin to move towards the second tube; and when the pin abuts against the second tube, the second tube is positioned.

2. The telescopic positioning structure of the ladder according to claim 1, wherein the second tube of the front supporting leg is connected to a tool stand.

3. The telescopic positioning structure of the ladder according to claim 1, wherein an end cover is arranged at the upper end of the rear supporting leg and is provided with a slope; when the rear supporting leg is unfolded, the slope abuts against the pin; and in a process of unfolding the rear supporting leg, the pin is pushed to move to position the second tube.

4. The telescopic positioning structure of the ladder according to claim 1, wherein the pin is connected to an elastic piece, and the elastic piece applies force to the pin to release the second tube.

5. The telescopic positioning structure of the ladder according to claim 4, wherein the second tube of the front supporting leg is connected to a tool stand.

6. The telescopic positioning structure of the ladder according to claim 4, wherein an end cover is arranged at the upper end of the rear supporting leg and is provided with a slope; when the rear supporting leg is unfolded, the slope abuts against the pin; and in a process of unfolding the rear supporting leg, the pin is pushed to move to position the second tube.

7. The telescopic positioning structure of the ladder according to claim 4, wherein the ladder further comprises a connecting piece fixedly connected to the front supporting leg; the connecting piece is provided with a mounting cavity; the first tube is allowed to be inserted in the mounting cavity; wherein the mounting cavity extends vertically through the connecting piece; and the first tube is arranged in the mounting cavity and is fixedly connected to the connecting piece.

8. The telescopic positioning structure of the ladder according to claim 7, wherein the connecting piece is provided with a second mounting cavity; and the second tube is allowed to extend in the second mounting cavity.

9. The telescopic positioning structure of the ladder according to claim 7, wherein the pin and the connecting piece are movably arranged in a radial direction of the first tube.

10. The telescopic positioning structure of the ladder according to claim 9, wherein the pin comprises a pin head and a pin handle; the pin head is fixedly connected to the pin handle; the pin handle having a rod to be sleeved with the elastic piece; the elastic piece is arranged around the rod; a first end of the rod abuts against the pin handle and a second end of the rod abuts against the connecting piece or the first tube.

11. The telescopic positioning structure of the ladder according to claim 7, wherein the second tube arranged in the mounting cavity is provided with a flange protruding out of an outer-diameter portion of the second tube; when the second tube moves upwards, the flange abuts against a cover, the pin is located on a lower end face of the second tube, and the first tube and the second tube are locked.

12. The telescopic positioning structure of the ladder according to claim 11, wherein the connecting piece is provided with a second mounting cavity; and the second tube is allowed to extend in the second mounting cavity.

13. The telescopic positioning structure of the ladder according to claim 11, wherein the pin and the connecting piece are movably arranged in a radial direction of the first tube.

14. The telescopic positioning structure of the ladder according to claim 13, wherein the pin comprises a pin head and a pin handle; the pin head is fixedly connected to the pin handle; the pin handle is provided with a rod to be sleeved with the elastic piece; the elastic piece is arranged around the rod; a first end of the rod abuts against the pin handle and a second end of the rod abuts against the connecting piece or the first tube.

* * * * *